US005214477A

United States Patent [19]

Hirobe et al.

[11] Patent Number: 5,214,477

[45] Date of Patent: May 25, 1993

[54] IMAGE FORMING APPARATUS HAVING A TONER DENSITY DETECTING DEVICE

[75] Inventors: Junichi Hirobe, Kodoma; Masakatsu Akashi, Kakogawa; Masahiko Kobayashi, Ikoma; Tsutomu Sugaya, Hirakata, all of Japan

[73] Assignee: Mita Industrial Co., Ltd., Osaka, Japan

[21] Appl. No.: 848,492

[22] Filed: Mar. 9, 1992

[30] Foreign Application Priority Data

Mar. 12, 1991 [JP] Japan ..... 3-046447

[51] Int. Cl.[5] ..... G03G 21/00

[52] U.S. Cl. ..... 355/246; 355/208; 355/214

[58] Field of Search ..... 355/203, 204, 208, 214, 355/245, 246; 118/688-690, 691

[56] References Cited

U.S. PATENT DOCUMENTS 3,932,034 1/1976 Takahashi ..... 355/246
4,089,297 5/1978 Morita et al. ..... 355/246 X
4,395,112 7/1983 Miyakawa et al. ..... 355/246
4,538,897 9/1985 Osaka et al. ..... 355/246

*Primary Examiner*—A. T. Grimley
*Assistant Examiner*—William J. Royer
*Attorney, Agent, or Firm*—Jordan and Hamburg

[57] ABSTRACT

An image forming apparatus comprises a photoreceptor, a developing roller for forming a layer of developer on a surface thereof to supply toner to the photoreceptor at a developing position, a bias supply for applying bias voltage between the developing roller and a ground, a conductive line for electrically connecting the developer layer with the ground, a detector for detecting toner density of the developer layer based on an amount of electric current flowing through the conductive line, and a voltage controller for preventing surface voltage of the developer layer from falling below a predetermined level despite the electric current flowing into the conductive line at least during a developing operation. Accordingly, there can be reliably prevented formation of fog on a copy because the surface voltage of the developer layer is maintained above the specified level at least during the developing operation.

6 Claims, 4 Drawing Sheets

IMAGE FORMING APPARATUS HAVING A TONER DENSITY DETECTING DEVICE

BACKGROUND OF THE INVENTION AND RELATED ART STATEMENT

This invention relates to an image forming apparatus having a toner density detecting device.

Conventionally, in an image forming apparatus using bicomponent developer consisting of toner and carrier, a developing unit is provided with a toner density sensor for detecting toner density of the developer. Supply of the toner is controlled in accordance with a sensor signal from the toner density sensor to maintain a proper toner density, thereby preventing the toner from being excessively or deficiently fed to a photosensitive drum.

A low cost image forming apparatus requires assemblage from low cost parts. However, toner density sensors are generally relatively expensive because they include a magnetic sensor or like sensor. Accordingly, there has been an increasing demand for a toner density sensor which can be fabricated at low cost, instead of the existing expensive toner density sensors.

It is a well-known concept that a resistance value of developer varies according to a mixing ratio of toner to carrier, namely toner density, in the developer.

In view of the above concept, Unexamined Japanese Patent Publication 58-169161 has proposed an image forming apparatus including a detector circuit in which a resistor is connected between a regulating member for regulating thickness of a layer of developer formed on the surface of a developing roller and a ground to detect the toner density. More specifically, a bias voltage is applied to the developing roller in order to prevent formation of fog on a copy. The detector circuit detects an electric current caused by the bias voltage and flowing into the resistor through the developing roller, developer layer and regulating member, whereby to detect the toner density.

However, in the above detector circuit, the bias voltage is divided by the resistance of the developer and the resistor. The surface voltage of the developer layer formed on the developer roller is reduced, thereby making it difficult to reliably prevent formation of the fog on the copy.

In order to avoid the above drawback, it may be considered to increase the level of the bias voltage. However, this necessitates fabrication of the developing roller having improved resistance against voltage at an increased cost.

SUMMARY OF THE INVENTION

It is an object of the present invention to provide an image forming apparatus having a toner density detecting device having a simple construction and capable of detecting toner density of developer without reducing surface voltage of a layer of developer formed on a developing roller during a developing operation.

Accordingly, an image forming apparatus of the invention comprises a photoreceptor, a developing roller for forming a layer of developer on a surface thereof to supply toner to the photoreceptor at a developing position, bias supply means for applying a bias voltage between the developing roller and a ground, a conductive line for electrically connecting the developer layer with the ground, detector means for detecting toner density of the developer layer based on an amount of electric current flowing through the conductive line, and voltage control means for preventing surface voltage of the developer layer from falling below a predetermined level despite the electric current flowing into the conductive line at least during a developing operation.

With the image forming apparatus thus constructed, the bias voltage is applied between the developing roller and ground, thereby causing electric current to flow through the conductive line. The toner density of the developer layer is detected based on the amount of electric current. Further, the reduction in the surface voltage of the developer roller is formed on the developing roller controlled by the voltage control means. Accordingly, the toner density can be detected while reliably preventing formation of fog on a copy.

The voltage control means may be provided with switch means for disconnecting the developer layer from the ground during the developing operation, second detector means for detecting whether the developing operation is currently executed, and control means for driving the switch means to disconnect the developer layer from the ground in the case where the second detector means detects that the developing operation is currently executed.

With this arrangement, the switch means disconnects the developer layer from the ground during the developing operation, thereby preventing the surface voltage of the developer layer from falling below the specified level during the developing operation. Accordingly, formation of fog on a copy can be reliably prevented at lower cost.

The second detector means may include charge signal generator means for detecting start and end of the driving of the charger means to generate a charge start signal and a charge end signal, and third detector means for detecting start and end of the developing operation based on a predetermined period required for a specified position of the photoreceptor to reach from the charging position to the developing position, the charge start signal and the charge end signal.

With this arrangement, a period during which the developing operation is executed is detected accurately with a simple construction. Accordingly, formation of fog on a copy can be prevented reliably at lower cost.

Further, the voltage control means may include constant voltage generator means for applying constant voltage between the developer layer and ground.

With this arrangement, since the constant voltage is applied to the developer layer, detection of the toner density can always be conducted and formation of fog on a copy can be reliably prevented. Also, the voltage control means can be constructed more simply.

The constant voltage generator means may be a voltage-regulator diode.

Further, the conductive line may have a connecting member in contact with the developer layer and serving as a regulating member for regulating thickness of the developer layer.

These and other objects, features and advantages of the present invention will become more apparent upon a reading of the following detailed description and accompanying drawings.

DETAILED DESCRIPTION OF PREFERRED EMBODIMENTS OF THE INVENTION

Figure 1:
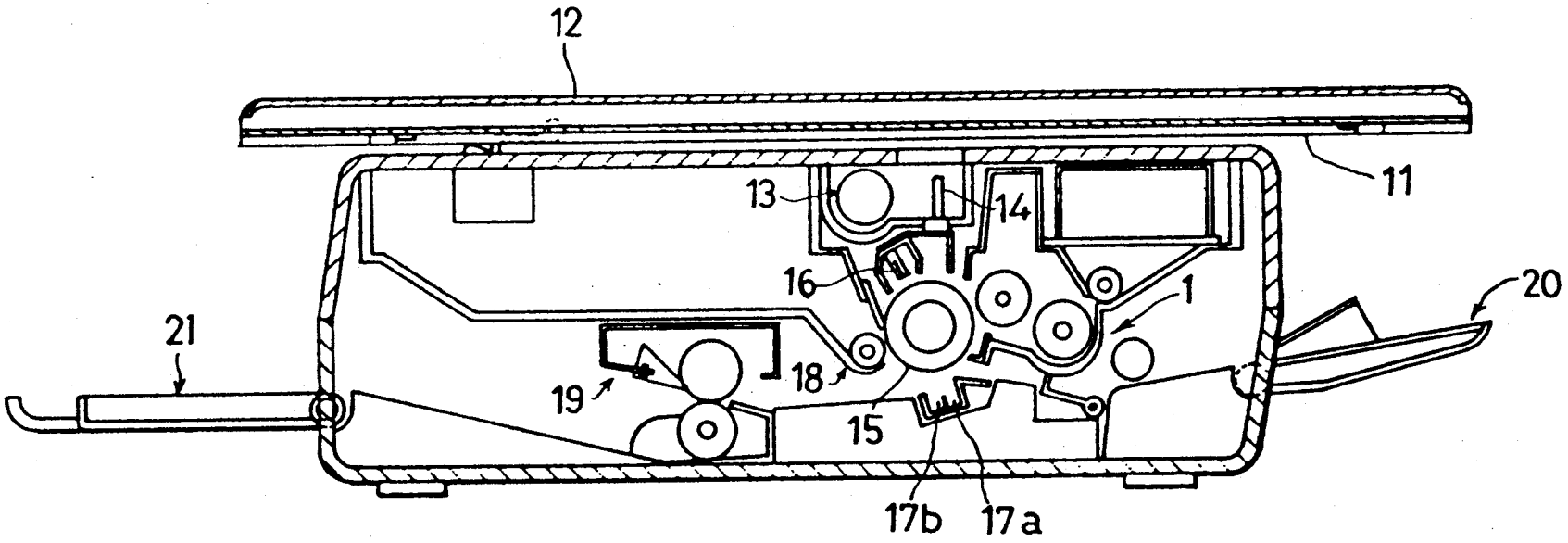
FIG. 1 is a schematic front view in section showing an image forming apparatus embodying the invention.

FIG. 1 is a schematic front view in section showing an image forming apparatus embodying the invention.

The image forming apparatus has at a top thereof a movable document table including a platen glass 11 and a document holder 12, and a main body below the movable table. A document to be copied is placed on an upper surface of the platen glass 11. An exposure unit, image forming unit, and fixing unit 19 are provided in the interior of the apparatus main body. The exposure unit includes light source 13 such as a lamp and a condenser lens 14. The image forming unit includes a photoreceptor such as a photosensitive drum 15, charger 16, developing unit 1, transfer device 17*a*, separating device 17*b*, cleaning device 18, etc. Further, a sheet insertion guide 20 and a discharge tray 21 are provided at right and left sides of the apparatus main body in the drawing of FIG. 1. Upon start of a copying operation, light emitted from the light source 13 is reflected by a document surface placed on the platen glass 11. The reflected light is projected onto the drum 15 by way of the condenser lens 14. On the other hand, the surface of the drum 15 is charged by the charger 16 and exposed to the light from the condenser lens 14, thereby forming an electrostatic latent image thereon.

The electrostatic latent image is developed by developing unit 1 into a toner image, which is in turn transferred onto a copy sheet inserted along the sheet insertion guide 20 by the transfer device 17*a*. Then, the copy sheet is separated from the surface of the drum 15 by the separating device 17*b*. The copy sheet having a document image transferred thereto is transported to the fixing unit 19 wherein the transferred document image is fixed to the copy sheet. Then, the copy sheet is discharged onto the discharge tray 21. The toner residual on the surface of the drum 15 after an image forming operation is cleaned by the cleaning device 19.

Figure 3:
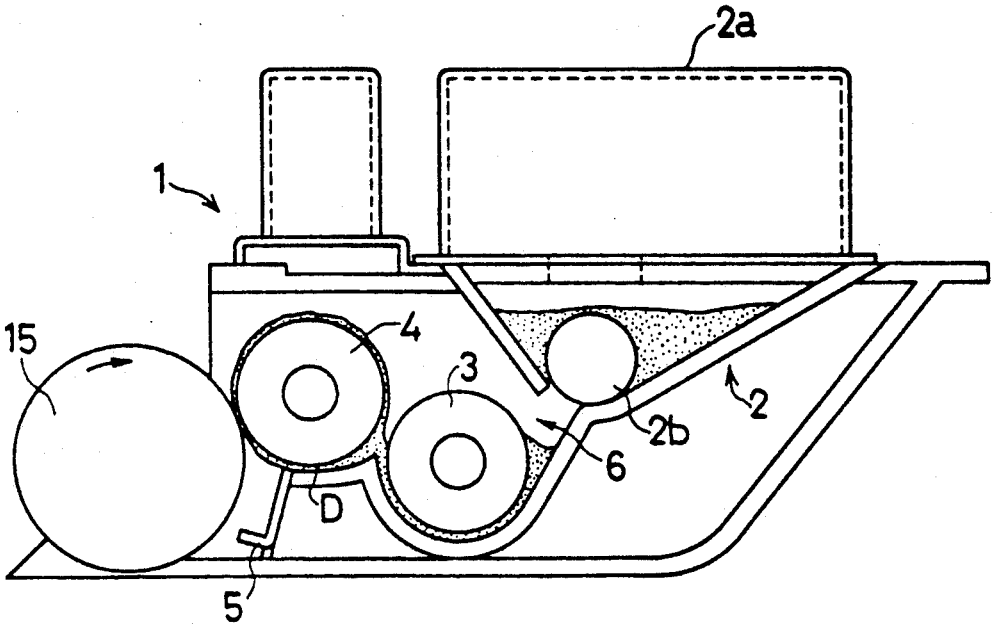
FIG. 3 is a schematic front view in section showing an exemplary developing unit provided in the image forming apparatus.

Next, there will be described an example of a construction of the developing unit 1 with reference to FIG. 3.

The developing unit 1 is provided with a toner container 2 and developing device 6 including an agitating roller 3, developing roller 4, regulating or connecting member 5 and the like. The toner container 2 stores toner supplied from a toner cartridge 2*a*. A toner supply roller 2*b* provided in a lower portion of the toner container 2 is driven in accordance with a drive signal sent from a control unit 10 to be described later, whereby the toner is supplied to the developing device 6.

The agitating roller 3 agitates and mixes bicomponent developer consisting of toner and carrier in the developing device 6. The developing roller 4 supplies the toner to the photosensitive drum 15 by forming a layer of developer D on the surface thereof. The regulating member 5 is spaced away from the surface of the developing roller 4 by a specified distance, and regulates the developer layer D to attain proper thickness. The regulating member 5 provides a conductor, which serves as an electrode for detecting the toner density as will be described later.

Figure 2:
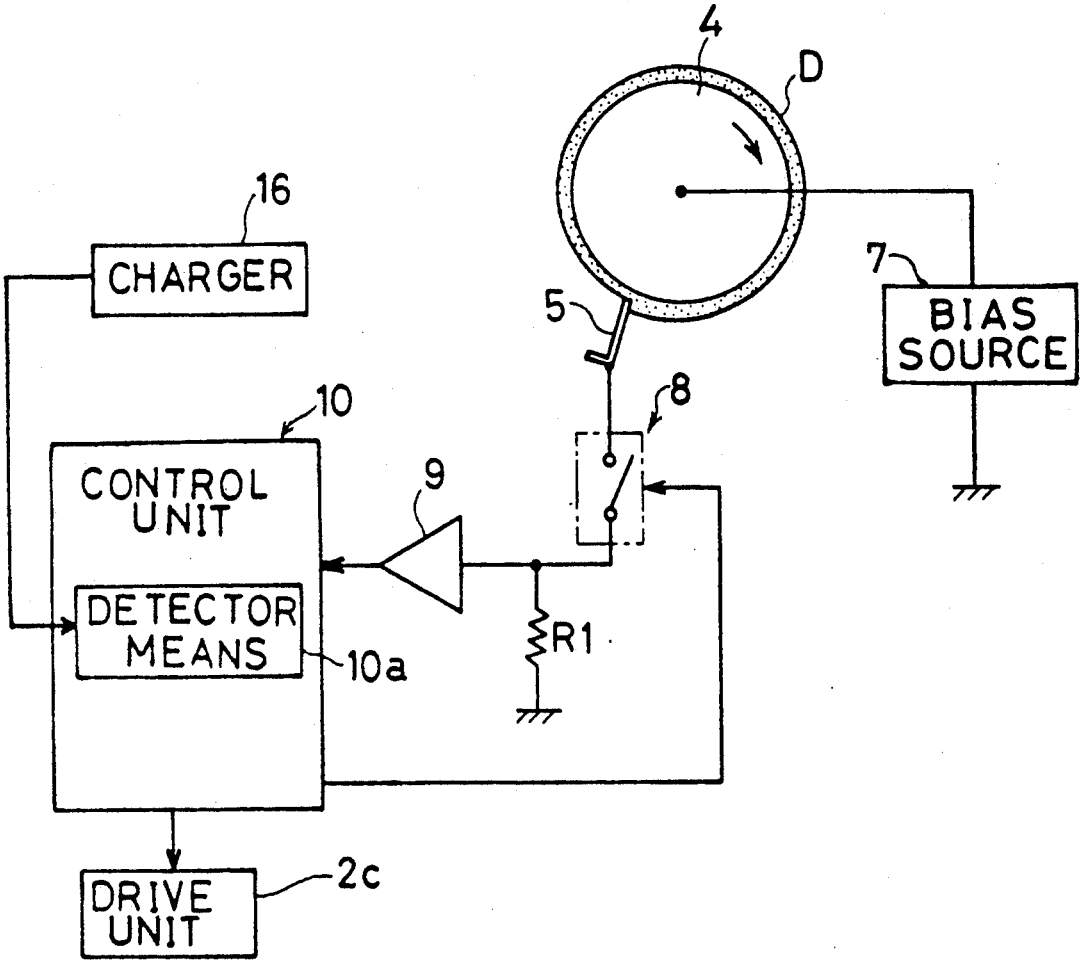
FIG. 2 is a diagram showing a first toner density detecting device for use in the image forming apparatus.

Next, there will be described a first toner density detecting device provided in the developing unit 1 with reference to FIG. 2.

A bias source 7 applies bias voltage to the developer layer D by way of the developing roller 4 in order to prevent formation of fog on a copy. A switch 8 and a resistor R1 are connected between the regulating member 5 and a ground. In FIG. 2, regulating member 5 and resistor R1 constitute a conductive line means which electrically connects developer layer D with ground. The bias voltage applied to the developing roller 4 causes an electric current to flow into the resistor R1 through the developer layer D and switch 8. As a result, a voltage is developed by the resistor R1. Since the resistance of the developer layer D varies according to the toner density of the developer layer D as mentioned above, the electric current flowing into the resistor R1 also varies according thereto. An amplifier 9, connected to the resistor R1, amplifies the voltage developed by the resistor R1 using a specified amplification factor and outputs the amplified voltage to the control unit 10 in the form of a voltage signal.

The switch 8 is turned on or off in accordance with a control signal from the control unit 10. The control unit 10 includes a CPU (central processing unit) and the like, and detects the toner density of the developer layer D in accordance with the voltage signal from the amplifier 9. Control unit 10 therefore functions as a first detector means for detecting toner density of the developer layer. In the case where the detected toner density is not in excess of a predetermined value, the control unit 10 sends a drive signal to a drive unit 2*c* including a drive roller or the like for driving the toner supply roller 2*b* of the toner container 2. The toner supply roller 2*b* is driven in response to the drive signal from the control unit 10, whereby the toner is supplied to the developing device 6.

The control unit 10 includes a second detector means 10*a* for detecting a developing period. The developing period is a period during which the toner in the developer deposited on the developing roller 4 is attracted to the electrostatic latent image formed on the surface of the drum 15. The detector means 10*a* carries a charging detector and a determining device. The charging detector or charge signal generator means detects a charging start timing and a charging end timing at which driving of the charger 16 is started and completed, and generates charge start and charge end signals corresponding thereto. The determining device which constitutes a third detector means, driven together with the charging detector, determines a developing start timing and a developing end timing at which the developing operation is started and completed. The determining device includes two counters for measuring a delay period calculated based on a distance between the charging position and developing position on the surface of the drum 15, and a rotating speed of the drum 15. The one counter is started at the charging start timing while the other started at the charging end timing. The determining device determines timings at which the respective counters complete counting as the developing start and end timings. In this way, the developing start and end timings are detected.

Further, the developing period may be detected more approximately using simpler detector means. For example, detector means detects timings at which the driving of the charger 16 is started and the driving of the transfer device 17*a* is completed and determines these timings as a developing start timing and developing end timing respectively. Alternatively, the detector means detects timings at which the moving of the document table is started and completed and determines these timings as a developing start timing and developing end timing respectively. Switch 8, control unit 10 and second detector means 10*a* together form a voltage control means for preventing surface voltage of the developer layer from falling below a predetermined level during a developing operation.

Figure 4:
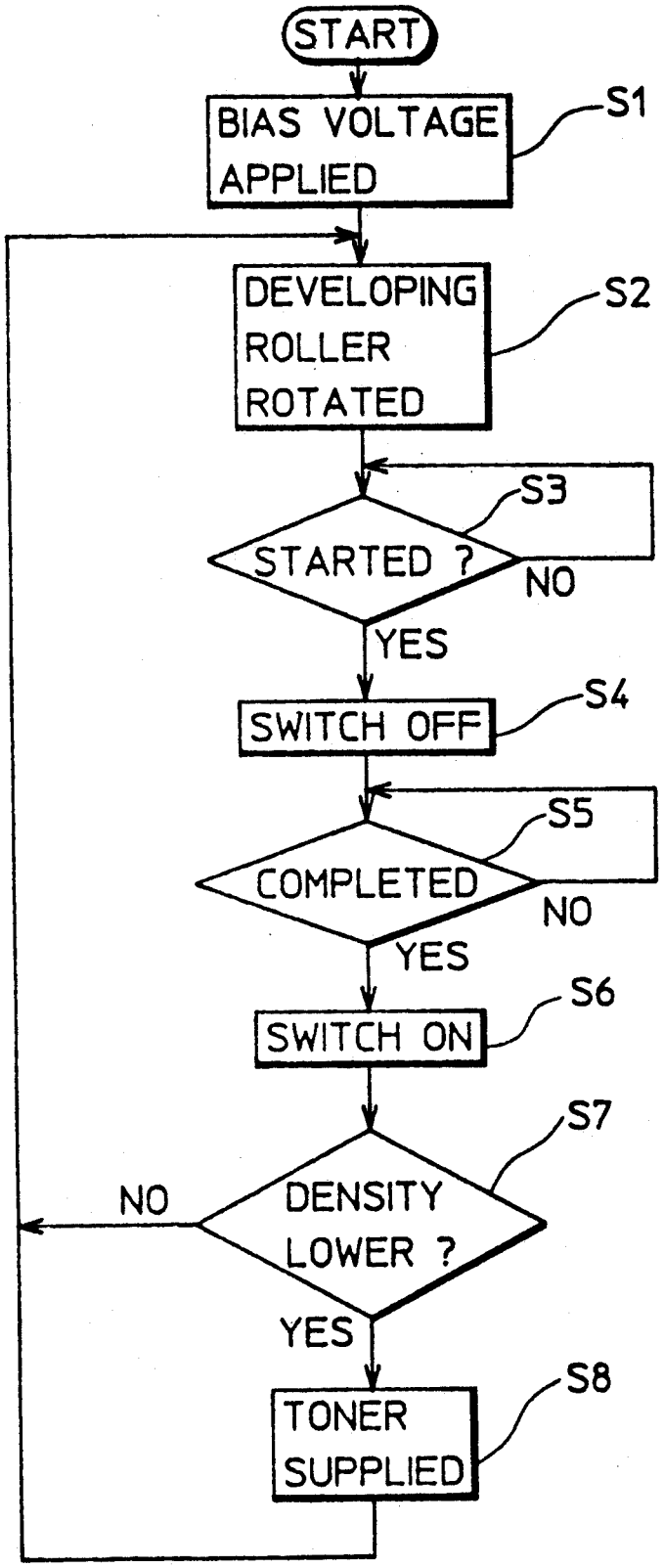
FIG. 4 is a flow chart showing a toner density detecting operation.

There will be described a toner density detecting operation with reference to a flow chart shown in FIG. 4. At the start of this operation flow, the switch 8 is in an ON state.

In Step S1, the bias supply 7 applies the bias voltage to the developing roller 4. Subsequently, the developing roller is drivingly rotated in Step S2, whereby the developer deposits on the surface of the developing roller 4 forming the developer layer D thereon. The developer layer D is regulated by the regulating member 5 so as to attain the specified thickness. In Step S3, it is discriminated whether the developing operation has been started. If the developing operation has not been started yet (NO in Step S3), this operation flow waits in Step S3.

If the start of the developing operation is detected (YES in Step S3), the switch 8 is turned off upon receipt of the control signal from the control unit 10 in Step S4, whereby the resistor R1 and regulating member 5 are disconnected from each other. In other words, the voltage applied to the developer layer D on the developing roller 4 is not to be divided by the resistor R1, therefore preventing reduction in the surface voltage of the developer layer D.

Thereafter, it is discriminated whether the developing operation has been completed in Step S5. If the developing operation has not been completed yet (NO in Step S5), this operation flow waits in Step S5. On the other hand, if the developing operation has been completed (YES in Step S5), the switch 8 is turned on in Step S6, whereby the resistor R1 and regulating member 5 are connected to each other. Then, the electric current caused by the bias voltage flows into the resistor R1 through the developer layer D and switch 8. The voltage developed by the resistor R1 is input to the control unit 10 in the form of a voltage signal after amplified by the being amplifier 9. The control unit 10 detects the toner density of the developer layer D in accordance with the voltage signal from the amplifier 9, and discriminates whether the detected toner density is not in excess of the predetermined value in Step S7. If the detected toner density is not in excess of the predetermined value (YES in Step S7), in Step S8, the control unit 10 sends the drive signal to the drive unit 2*c* to drive the toner supply roller 2*b*, whereby the toner is supplied to the developing device 6 from the toner container 2. If, on the other hand, the detected toner density is in excess of the predetermined value (NO in Step S7), this step returns to Step S2.

As described above, the switch 8 is turned off to disconnect the resistor R1 and regulating member 5 from each other during the developing operation. Accordingly, the voltage applied to the developer layer D on the developing roller 4 is not divided by the resistor R1 so as to be reduced to a lower level; and the surface voltage of the developer layer D does not decrease. Therefore, formation of the fog on the copy can be reliably prevented.

In the first toner density detecting device, the switch 8 is kept off only during the developing operation. However, since the toner density does not change drastically, it may be appropriate that the toner density of the developer layer D is detected at regular intervals. In this case, the switch 8 is kept on only when the toner density is detected. Even in this case, the switch 8 is kept off during the developing operation in order to prevent formation of the fog on the copy.

Figure 5:
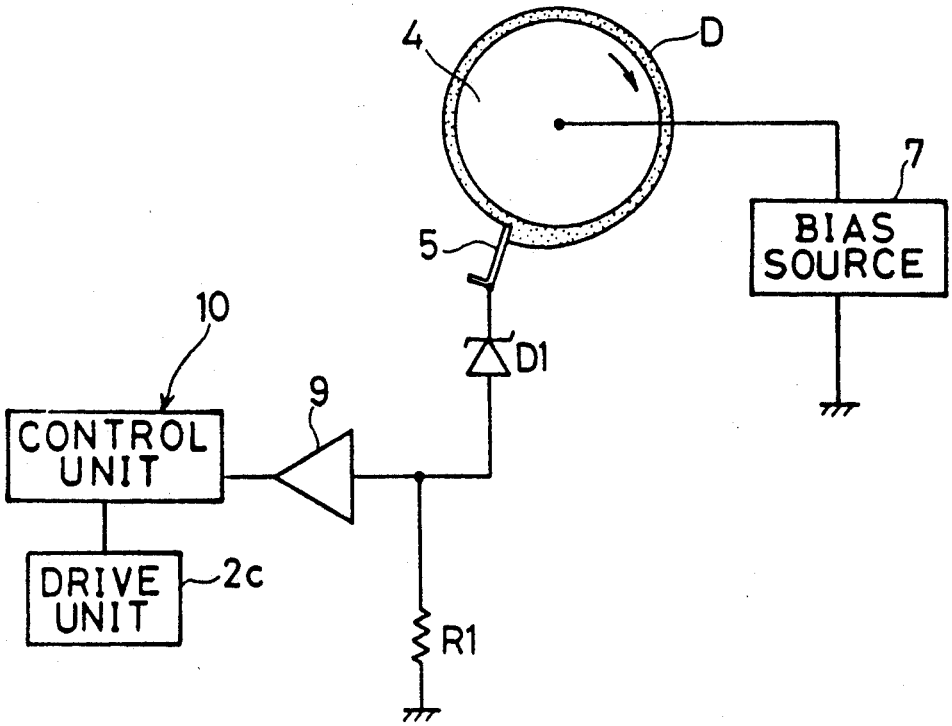
FIG. 5 is a diagram showing a second toner density detecting device for use in the image forming apparatus.

Next, there will be described a second toner detecting device of the developing unit 1 with reference to FIG. 5, wherein the same numerals designate the same parts shown in FIG. 3.

In the second toner detecting device, a constant voltage generator means such as a zener diode D1 is used in place of the switch 8 of the first detecting device. The zener diode D1 functions as a voltage-regulator diode and maintains the surface voltage of a developer layer D formed on a developing roller 4 at or above a predetermined ON-state voltage determined by characteristics thereof. Formation of fog on a copy can be prevented by setting the ON-state voltage of the zener diode D1 at or above such a voltage as not to cause the fog on the copy.

Further, an electric current constantly flows into a resistor R1 through the developer layer D, regulating member 5, and zener diode D1 as long as a bias voltage is applied to the developing roller 4. Therefore, the toner density of the developer layer D can be detected constantly.

As described above, since the toner density of the developer layer D is constantly detected by the second toner density detecting device, it is not necessary for a control unit 10 to discriminate whether the developing operation is currently executed, thereby obviating the need for a detector 10*a* for detecting a developing period. Accordingly, when the second toner density detecting device is adopted, operations of Steps S3 to S6 of the aforementioned flow chart can be omitted.

Moreover, in the second toner density detecting device, the zener diode D1 is connected in series between the regulating member 5 and resistor R1. However, the zener diode D1 may be connected in series between the resistor R1 and a ground. Even in this case, the surface voltage of the developer layer D is maintained at a voltage which is a sum of the ON-state voltage of the zener diode D1 and the voltage developed by the resistor R1. Accordingly, the surface voltage of the developer layer D does not fall below the ON-state voltage.

In the above description, the regulating member 5 serves as an electrode for detecting the toner density. However, it may be appropriate to provide a special electrode in contact with the developer layer D and to cause an electric current to flow into the resistor R1 through the electrode.

Although the present invention has been fully described by way of example with reference to the accompanying drawings, it is to be understood that various changes and modifications will be apparent to those skilled in the art. Therefore, unless such changes and modifications depart from the scope of the present invention, they should be construed as being included therein.

What is claimed is:

1. An image forming apparatus comprising:

a photoreceptor;

developing roller means for forming a layer of developer on a surface thereof so as to supply toner to the photoreceptor at a developing position;

bias supply means for applying a bias voltage between the developing roller means and a ground;

conductive line means for electrically connecting the developer layer with the ground;

first detector means for detecting toner density of the developer layer based on an amount of electric current flowing through the conductive line means; and voltage control means for preventing surface voltage of the developer layer from falling below a predetermined level even though electric current flows into the conductive line.

2. An image forming apparatus as defined in claim 1 wherein the voltage control means includes:

switch means provided in a specified position in the conductive line for electrically connecting and disconnecting the developer layer to and from the ground;

second detector means for detecting whether the developing operation is being executed; and control means for controlling the switch means to electrically disconnect the developer layer from the ground when the second detector means detects that the developing operation is being executed.

3. An image forming apparatus as defined in claim 1 further comprising charger means for charging the photoreceptor at a charging position and wherein the second detector means includes:

charge signal generator means for detecting a start and an end of the charging by the charger means and for generating a charge start signal and a charge end signal in correspondence therewith; and third detector means for detecting a start and an end of the developing operation based on a predetermined period required for a specified position of the photoreceptor to reach from the charging position to the developing position, in response to said charge start signal and charge end signal.

4. An image forming apparatus as defined in claim 1 where the voltage control means includes constant voltage generator means provided in a specified position in the conductive line means for applying a constant voltage between the developer layer and the ground.

5. An image forming apparatus as defined in claim 4 wherein the constant voltage generator means is a voltage-regulator diode.

6. An image forming apparatus as defined in claim 1 wherein the conductive line means has a connecting member in contact with the developer layer and the connecting member serves as regulating means for regulating thickness of the developer layer formed on the surface of the developing roller.

* * * * *